US009616326B2

(12) United States Patent
Murdock

(10) Patent No.: US 9,616,326 B2
(45) Date of Patent: Apr. 11, 2017

(54) DIGITAL DETECTION OF PHYSICAL DICE ROLLS VIA CONDUCTIVE DICE TRAY

(71) Applicant: Disney Enterprises, Inc., Burbank, CA (US)

(72) Inventor: Malcolm Murdock, Los Angeles, CA (US)

(73) Assignee: Disney Enterprises, Inc., Burbank, CA (US)

( * ) Notice: Subject to any disclaimer, the term of this patent is extended or adjusted under 35 U.S.C. 154(b) by 609 days.

(21) Appl. No.: 14/181,286

(22) Filed: Feb. 14, 2014

(65) Prior Publication Data

US 2015/0231486 A1 Aug. 20, 2015

(51) Int. Cl.

| | |
|---|---|
| ***A63F 9/24*** | (2006.01) |
| ***A63F 13/00*** | (2014.01) |
| ***G06F 17/00*** | (2006.01) |
| ***G06F 19/00*** | (2011.01) |
| ***A63F 9/04*** | (2006.01) |

(52) U.S. Cl.
CPC ..... *A63F 9/0468* (2013.01); *A63F 9/04* (2013.01); *A63F 9/0402* (2013.01); *A63F 2009/2489* (2013.01)

(58) Field of Classification Search
CPC ..... A63F 9/04; A63F 9/0402; A63F 9/0468; A63F 2009/2489
USPC ..... 463/22
See application file for complete search history.

(56) References Cited

U.S. PATENT DOCUMENTS 5,694,045 A * 12/1997 Ikeda ..... A63F 9/04 273/145 R
2013/0012313 A1* 1/2013 Chen ..... A63F 9/143 463/31

OTHER PUBLICATIONS

Jonathan Fincher: "Scosche gambles on smartROLL Bluetooth-enabled dice for tablets", gizmag, Jun. 12, 2013 (Jun. 12, 2013), Retrieved from the Internet: URL: http://www.gizmag.com/scosche-smartroll-bluetooth-enabled-dice/27892/.
"Get DICE+, The #1 Gaming Accessory for Tablets", dicepl, Retrieved from the Internet: URL: http://dicepl.us/special/.

* cited by examiner

*Primary Examiner* — Omkar Deodhar
*Assistant Examiner* — Wei Lee
(74) *Attorney, Agent, or Firm* — Farjami & Farjami LLP

(57) ABSTRACT

There is provided a system and method for determining an identity of a game piece. The system including a detection grid, a memory for storing a detection algorithm, and a processor configured to detect an electrical change on the detective grid caused by a contact face from the game piece, determine the identity of the game piece based on the electrical change using the detection algorithm, and transmit the identity of the game piece wirelessly. The game piece may include a die with a plurality of resistors, where each of the plurality of faces includes a resistor with a different resistance value. The identity of the die corresponds to the rolled face of the die. Wherein detecting the rolled face of the die includes detecting the resistance value on the contact face of the die and determining the rolled face based on the detected resistance value.

17 Claims, 4 Drawing Sheets

DIGITAL DETECTION OF PHYSICAL DICE ROLLS VIA CONDUCTIVE DICE TRAY

BACKGROUND

Bridging the digital and physical world in gaming gives users the opportunity to experience physical contact with game pieces while at the same time experiencing everything the digital world has to offer. Systems that bridge the digital and physical world usually rely on cameras to watch and detect game pieces while a user is moving the game pieces on a physical board. The cameras work by utilizing optical recognition techniques that can detect the movement of game pieces.

However, problems arise when users are playing games that involve the detecting game pieces in different orientations during the game. For example, if a user is rolling a dice to play a physical game, it can be difficult for cameras using optical recognition to determine which face of the die has been rolled. This same problem can exist with other game pieces where orientations are important. For another example, if a user is playing a game that involves playing cards, it can be difficult for cameras using optical recognition to determine which face of the card is facing upwards. One solution that has been developed to solving this problem is to embed technology in the game pieces themselves that can detect an orientation of the game piece and then can transmit that information as data to an electronic device. However, these systems are expensive, as each game piece requires its own embedded technology.

SUMMARY

The present disclosure is directed to a conductive dice tray used for the digital detection of physical dice rolls, substantially as shown in and/or described in connection with at least one of the figures, as set forth more completely in the claims.

DETAILED DESCRIPTION

Figure 1:
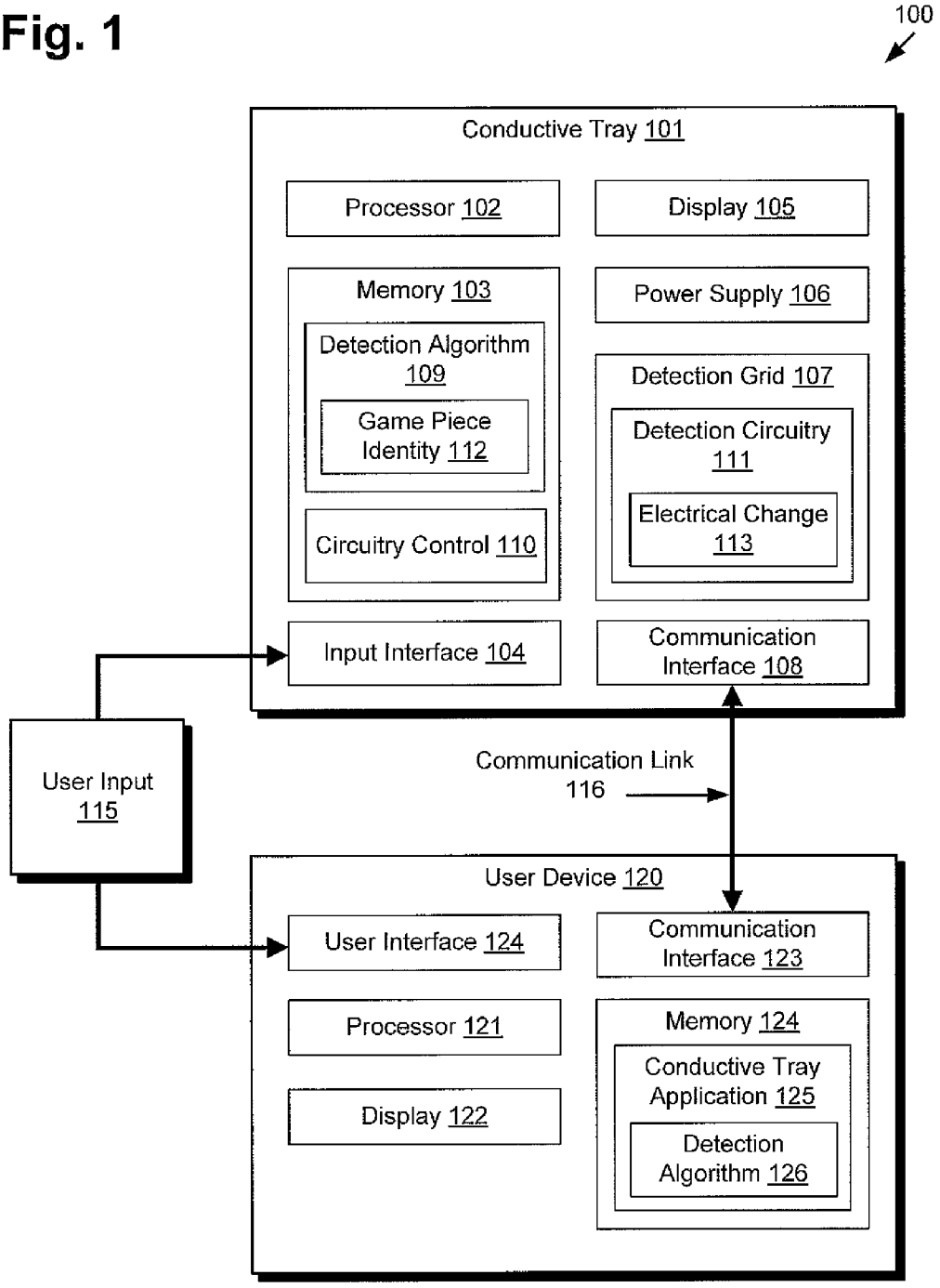
FIG. 1 presents a system for digitally detecting a physical dice roll using a conductive dice tray, according to one implementation of the present disclosure.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

FIG. 1 presents a system for digitally detecting a physical dice roll using a conductive dice tray, according to one implementation of the present disclosure. System 100 of FIG. 1 includes conductive tray 101, user input 115, communication link 116, and user device 120. Conductive tray 101 includes processor 102, memory 103, input interface 104, display 105, power supply 106, detection grid 107, and communication interface 108. Memory 103 includes detection algorithm 109 and circuitry control 110. Detection algorithm 109 includes game piece identity 112. Detection grid 107 includes detection circuitry 111. Detection circuitry 111 includes electrical change 113. User device 120 includes processor 121, display 122, communication interface 123, user interface 124, and memory 124. Memory 124 includes conductive tray application 125. Conductive tray application 125 includes detection algorithm 126. A processor may correspond to a processing device, such as a microprocessor or similar hardware processing device, or a plurality of hardware devices. For example, processors 102 and 121 may correspond to an Intel processor or an AMD processor. A memory may correspond to a non-transitory storage device, e.g. a computer-readable storage medium such as a computer hard-drive, random-access memory (RAM), or a portable memory device such as a compact disc read-only memory (CD-ROM) or external Universal Serial Bus (USB) connected memory, for example.

Conductive tray 101 comprises a conductive game board that is utilized by a user playing physical games with interactive game pieces. As shown in FIG. 1, conductive tray 101 includes input interface 104 and display 105. Input interface 104 may comprise, for example, a keyboard, a mouse, a game controller, a touch-screen input, a thermal and/or electrical sensor, or any other device capable of accepting user input 115 for use with conductive tray 101. Display 105 may comprise a liquid crystal display (LCD) screen built into conductive tray 101. In alternative implementations of the present disclosure, display 105 may be another type of display hardware, such as cathode-ray tubes (CRT) monitors. In yet other implementations, display 105 may also be touch sensitive and may serve as input interface 104. Moreover, user interface 104 and display 105 may be externally attached to conductive tray 101 through physical or wireless connection.

Conductive tray 101 further includes processor 102 and memory 103. Processor 102 may be configured to access memory 103 to store received input or to execute commands, processes, or programs stored in memory 103, such as detection algorithm 109 and circuitry control 110. Processor 102 may correspond to a processing device, such as a microprocessor or similar hardware processing device, or a plurality of hardware devices. However, in other implementations processor 102 refers to a general processor capable of performing the functions required of conductive tray 101. Memory 103 is a sufficient memory capable of storing commands, processes, and programs for execution by processor 102. Memory 103 may be instituted as ROM, RAM, flash memory, or any sufficient memory capable of storing a set of commands. In other implementations, memory 103 may correspond to a plurality memory types or modules.

Conductive tray 101 further includes communication interface 108. Processor 102 of conductive tray 101 is configured to control communication interface 108 to communicate with other electronic devices. In some implementations, those other electronic devices include user devices, such as communicating with user device 120 through communication interface 126 of user device 120, as illustrated by communication link 116. Communication interface 108 and communication interface 126 can utilize, as examples, one or more of Wireless Fidelity (Wi-Fi), Worldwide Interoperability for Microwave Access (WiMax), ZigBee, Bluetooth, Algorithm Division Multiple Access (CDMA), Evolution-Data Optimized (EV-DO), Global System for Mobile Communications (GSM), Long Term Evolution (LTE), and other types of wireless interfaces.

Also illustrated in FIG. 1, conductive tray 101 includes detection grid 107. Detection grid 107 is the interactive portion of conductive tray 101 that is utilized to detect physical game pieces by using detection circuitry 111. In one implementation, detection grid 107 includes an alternating voltage pattern of high-voltage and low-voltage lines. In such an implementation, detection circuitry 111 is attached to the low-voltage lines and is utilized to detect changes in the voltage of detection grid 107, such as electrical change 113. The alternating voltage pattern is then flipped back and forth with a set frequency between the different voltage lines so that detection circuitry 111 can detect a game piece in any orientation on detection grid 107. For example, a game piece may include a resistor with two different contacts. The game piece is then detected on detection grid 107 by detection circuitry 111 detecting electrical change 113 when the two contacts of the game piece close a circuit on detection grid 107. Conductive tray 101 can then identify the game piece on detection grid 107 based on electrical change 113, which is the resistance of the game piece, as will be explained in more details below.

It is noted that the present disclosure is not limited to detection grid 107 including only voltage lines and detection circuitry 111 that detect for a resistance on a game piece. In other implementations, detection grid 107 includes detection circuitry 111 that detects for a capacitance from the game piece as electrical change 113. In such implementations, the game will include a capacitor with a different capacitance on each of its faces so that the game piece can be detected in any orientation, just like with the resistors. The conductive tray 101 can determine the identity of the game piece based on electrical change 113 caused by a capacitor installed on the game piece.

It is further noted that the present disclosure is not limited to detection grid 107 including voltage lines. In other implementations, detection grid 107 may include a series of coils of wires that create an inductive loop in conductive tray 101. In such implementations, the game piece can include different sized wires on each of its faces so that the game piece can be detected in any orientation. Detection grid 107 can then detect the game piece when there is a change in the inductance of the coils caused by one of the wires located on the game piece, which results in electrical change 113. Conductive tray 101 can then use electrical change 113 caused by the change in inductance in the coils to determine the identity of the game piece. For example, if the game piece is a die, the die will include a different size wire on each of its faces and detection grid 107 can use electrical change 113 caused by one of the wires on the die to determine the rolled face of the die.

Still in other implementations, detection grid 107 may be able to detect the game piece using radio-frequency identification (RFID) technology. In such implementations, the game piece may include an RFID chip on each of its faces so that the game piece can be detected in any orientation. Detection grid 107 will then include RFID readers that can read the RFID chips on the faces of the game piece to determine the orientation of the game piece. For example, if the game piece includes a die with an attached RFID chip on each of its faces, the RFID reader can read which RFID chip is in contact with detection grid 107 to determine which face of the die is touching detection grid 107. Conductive tray 101 can then use that information to determine which face of the die has been rolled.

Also illustrated in FIG. 1, conductive tray 101 further includes detection algorithm 109 and circuitry control 110 stored in memory 103. Detection algorithm 109 includes software code that detects electrical change 113 on detection grid 107, and then calculates and determines game piece identity 112 of the game piece based on electrical change 113. For example, and using the example above where the game piece includes a resistor, conductive algorithm 109 can detect when there is a change in resistance on detection grid 107 caused by a game piece, where the change in resistance corresponds to electrical change 113. Detection algorithm 109 can then calculate and determine game piece identity 112 of the game piece based on electrical change 113.

It should be noted that game piece identity does not only refer to the identity of a single game piece that is being used with conductive tray 101, but also refers to an orientation of the game piece or the identity of multiple game pieces being used with conductive tray 101. For example, if the game piece is a die, game piece identity can refer either to the identity of the game piece, which would be a die, or to one of the faces of the die depending on the orientation of the die after it has been rolled. For another example, if multiple game pieces are being used on conductive tray 101, game piece identity 112 can refer to the identity of a single one of the game pieces or game piece identity 112 can refer to the identity of all of the game pieces.

Circuitry control 110 includes user controls for conductive tray 101 that can be altered by the user through user input 115. As such, circuitry control 110 can be used to customize detection grid 107 depending on how detection grid 107 is being utilized. For example, and sticking with the example above where detection grid 107 includes alternating high-voltage and low-voltage line patterns, circuitry control 110 can be used to change the frequency at which different voltage patterns on detection grid 107 are utilized along with how long power is supplied to detection grid 107 at each change in voltage pattern. This way, a user of conductive tray 101 can customize the voltage pattern for each type of game that is being played, making detecting the game pieces more efficient for each game.

Also illustrated in FIG. 1, conductive tray 101 further includes power supply 106. Power supply 106 includes any power source that is capable of powering conductive tray 101. For example, power supply 106 may include an electrical plug that a user plugs into an outlet on a wall. For another example, power supply 106 may include batteries that a user places in conductive tray 101. In such an example, the batteries may be rechargeable.

Also illustrated in FIG. 1 is user device 120. User device 120 may comprise a personal computer, a mobile phone, a tablet, a video game console, or any other device capable of executing conductive tray application 125 in memory 124. As shown in FIG. 1, user device 120 includes display 122 and user interface 124. User interface 124 may comprise, for example, a keyboard, a mouse, a game controller, a touch-screen input, a thermal and/or electrical sensor, or any other device capable of accepting user input for use with user device 120. Display 122 may comprise a liquid crystal display (LCD) screen built into user device 120. In alternative implementations of the present disclosure, display 122 may be another type of display hardware, such as cathode-ray tubes (CRT) monitors. In yet other implementations, display 122 may also be touch sensitive and may serve as user interface 124. Moreover, display 122 and user interface 124 may be externally attached to user device 120 through physical or wireless connection.

User device 120 further includes processor 121 and memory 124. Processor 121 may be configured to access memory 124 to store received input or to execute commands, processes, or programs stored in memory 124, such as conductive tray application 125. Processor 121 may correspond to a processing device, such as a microprocessor or similar hardware processing device, or a plurality of hardware devices. However, in other implementations processor 121 refers to a general processor capable of performing the functions required of user device 120. Memory 124 is a sufficient memory capable of storing commands, processes, and programs for execution by processor 121. Memory 124 may be instituted as ROM, RAM, flash memory, or any sufficient memory capable of storing a set of commands. In other implementations, memory 124 may correspond to a plurality memory types or modules.

Also illustrated in FIG. 1, user device 120 further includes conductive tray application 125 in memory 124. Conductive tray application 125 includes a software application downloaded and installed on user device 120 through communication interface 123 or through another method. In the implementation of FIG. 1, user device 120 utilizes conductive tray application 125 to control conductive tray 101 through communication link 116 at communication interface 123. For example, user device 120 can utilize conductive tray application 125 to control circuitry control 110 of conductive tray 101 through communication link 116. In such an example, a user of user device 120 can utilize conductive tray application 125 to control detection grid 107 similarly to how the user can utilize circuitry control 110 of conductive tray 101 to control detection grid 107 discussed above.

Besides just controlling conductive tray 101, conductive tray application 125 can further identity a game piece on detection grid 107. Conductive tray application 125 can identity a game piece either through conductive tray 101 transmitting game piece identity 112 to user device 120, or by conductive tray 101 transmitting electrical change 113 to user device 120, both through communication link 116. For example, and as discussed above where detection circuitry 111 detects electrical change 113 on detection grid 107, conductive tray 101 may transmit electrical change 113 to user device 120 through communication link 116. User device 120 then executes detection algorithm 126 of conductive tray application 125 to determine the identity of the game piece based on electrical change 113. As such, detection algorithm 126 of user device 120 works in the same way as detection algorithm 109 of conductive tray 101 discussed above. User device 120 can then display the identity of the game piece to a user using display 122.

In the implementation of FIG. 1, a user of system 100 interacts with conductive tray 101 using at least one game piece. Detection circuitry 111 detects electrical change 113 on detection grid 107 from the game piece when the game piece comes into contact with detection grid 107. Next, conductive tray 101 can either determine game piece identity 112 based on electrical change 113 using detection algorithm 109, or transmit electrical change 113 to user device 120 through communication link 116. In implementations where conductive tray 101 determines game piece identity 112 using detection algorithm 109, conductive tray 101 can display game piece identity 112 on display 105, or conductive tray 101 can transmit game piece identity 112 to user device 120 through communication link 116. However, in implementations where conductive tray 101 transmits electrical change 113 to user device 120, user device 120 can determine the identity of the game piece based on electrical change 113 by using detection algorithm 126 of conductive tray application 125. User device 120 can then display the identity of the game piece to the user using display 122.

It should be noted that the implementation of FIG. 1 only discuses using conductive tray 101 to determine the identity of a single game piece based on electrical change 113, however, the present disclosure is not limited to using only a single game piece. In other implementations, conductive tray 101 can be used to determine the identity of multiple game pieces at the same time based on electrical change 113 caused by each of the game pieces. Conductive tray 101 can determine the identity of the multiple game pieces using two different methods.

In a first method, conductive tray 101 can use different circuitry patterns to measure individual detection squares of detection grid 107 at alternating time periods. As such, if two game pieces are placed on detection grid 107 at the same time, then conductive tray 101 can detect electrical change 113 caused by each of the game pieces at different times. Conductive tray 101 can then determine game piece identity 112 of each of the game pieces based on each electrical change 113. For example, if two dice are being rolled on detection grid 107, conductive tray 101 would use different circuitry patterns for detection grid 107 so that conductive tray 101 would detect electrical change 113 caused by the first die and then detect electrical change 113 caused by the second die. Conductive tray 101 would then use detection algorithm 109 to calculate the rolled face of each of the dice based on electrical change 113 of each of the dice.

In a second method, each game piece would include a resistor with a unique resistance value so that when detection algorithm 109 tried to determine game piece identity 112 of all the game pieces using the total electrical change 113 of all the game pieces, there would only be one possible combination of game pieces that could be on detection grid 107. For example, if two dice were being rolled on detection grid 107, each die would include a resistor with a unique resistance on each of its faces. Furthermore, resistors chosen between the dice would also have to be unique so that the total electrical change 113 for the two rolled dice could not be duplicated with any other orientation of rolls. For example, a total electrical change 113 of a first die rolling a one and a second die rolling a two would have to be different than the first die rolling a four and the second die rolling a five. As such, resistors for both dice would have to be chosen to make sure no matter what the tolled, there is only a single electrical change 113 that can be detected.

Figure 2:
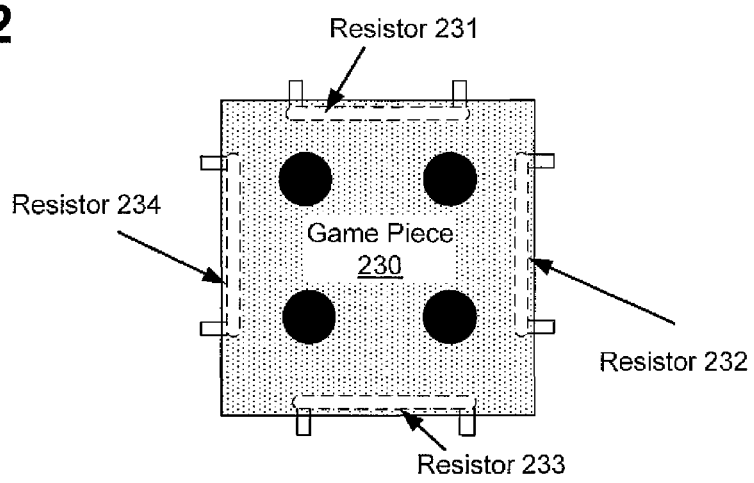
FIG. 2 presents a game piece for use with a conductive dice tray, according to one implementation of the present disclosure.

FIG. 2 presents a game piece for use with a conductive dice tray, according to one implementation of the present disclosure. Game piece 230 of FIG. 2 includes resistor 231, resistor 232, resistor 233, and resistor 234, which collectively will be referred to as resistors 231-234. It should be noted that although FIG. 2 only illustrates game piece 230 as including four built in resistors 231-234 for clarity, game piece 230 includes one resistor for each face of the die. For example, a standard die with six faces, as illustrated in FIG. 2, includes six different resistors. It is further noted that although the implementation of FIG. 2 illustrates game piece 230 including a die, the implementation of FIG. 2 is not limited to game piece 230 only including a die. In other implementations, game piece 230 can include any type of physical game piece which resistors can be installed on. For example, a game piece can include, but is not limited to, an action figure, cards, blocks, marbles, and chips. In each example, the game pieces can include any number of resistors depending on the number of orientations the game piece can make.

As illustrated in FIG. 2, game piece 230 is a die with built in resistors 231-234 on each face. In the implementation of FIG. 2, each of the resistors 231-234 on game piece 230 includes a different resistance value. As such, a conductive tray utilized by a user of game piece 230 is able to determine which face of the die has been rolled by calculating a change in resistance on the detection grid that is caused by one of resistors 231-234, as will be explained in greater detail below in regards to FIG. 3.

As further illustrated in FIG. 2, each of resistors 231-234 is built into game piece 230, however, the implementation of FIG. 2 is limited to built in resistors. In other implementations, the resistors of a game piece may come separate from the game piece to be installed by a user. For example, the resistors for a game piece may come with a pack of stickers, where the user places the resistors on the game piece using the stickers. In such an example, if the game piece were a die as in FIG. 2, the pack of stickers would include six different resistors, one for each face of the die. The user would then place each of the stickers with the corresponding resistor on the proper face of the die according to the resistance value of each resistor.

As further illustrated by the implementation of FIG. 2, game piece 230 only includes resistors 231-234, however, the implementation of FIG. 2 is not limiting. In other implementations, game piece 230 can include other electronic components than resistors 231-234. For example, and as discussed above, in implementations that use a capacitance to determine the identity of a game piece, the game piece would include a capacitor on each face, where each capacitor includes a different capacitance value. In such an example, a conductive tray could determine the identity of the game piece using the electrical change caused by one of the capacitors, where the electrical change corresponds to the capacitance value of the capacitor. For another example, and as discussed above, in implementations that use an inductive loop to determine the identity of a game piece, the game piece might include a wire on each face. In such an example, each wire would include a distinct size so that the conductive tray could determine the identity of the game piece based on the change of inductance on the detection grid caused by one of the wires. For a third example, as discussed above, in implementations that use RFID technology to determine the identity of a game piece, the game piece might include an RFID chip on each face. In such an example, RFID readers can determine identity of the game piece based on reading one of the RFID chips on the game piece.

Figure 3:
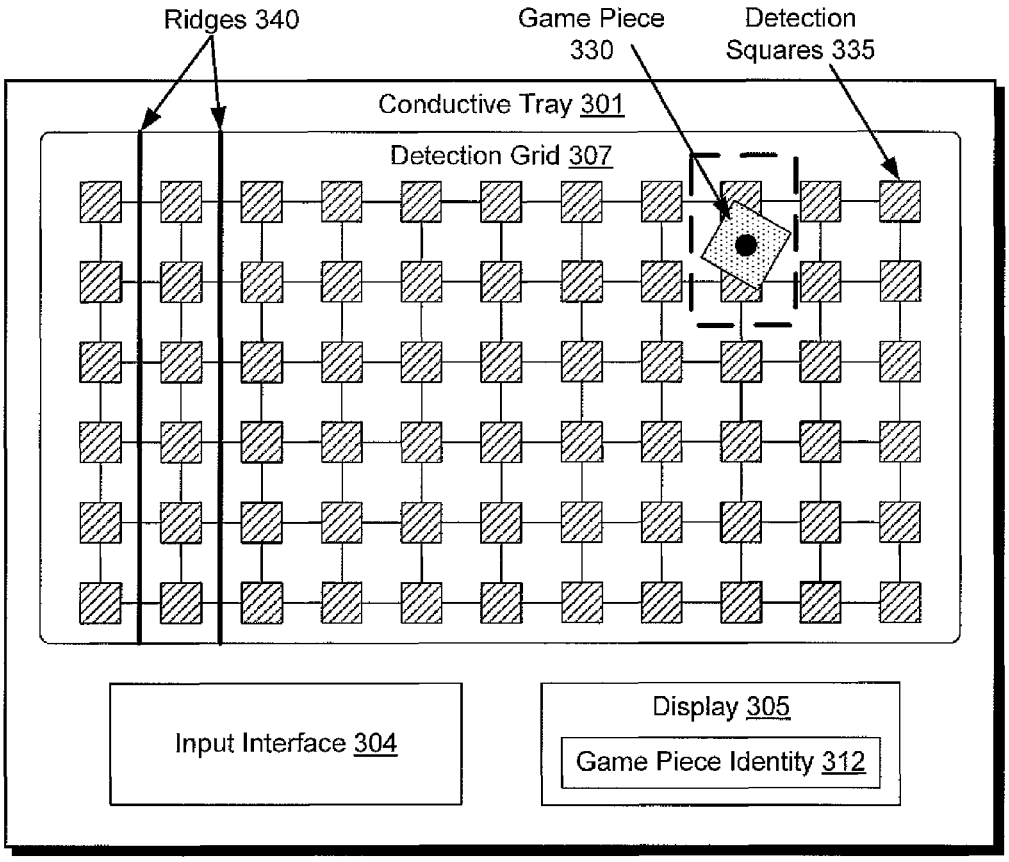
FIG. 3 presents an example of a conductive dice tray utilizing a game piece, according to one implementation of the present disclosure.

FIG. 3 presents an example of a conductive dice tray utilizing a game piece, according to one implementation of the present disclosure. Conductive tray 301 of FIG. 3 includes input interface 304, display 305, and detection grid 307. Display 305 includes game piece identity 312. Detection grid 307 detection squares 335 and ridges 340. Conductive tray 301 also includes game piece 330, which is being utilized by a user of conductive tray 301. It should be noted with respect to FIG. 3 that conductive tray 301, input interface 304, display 305, detection grid 307, and game piece identity 312 correspond respectively to conductive tray 101, input interface 104, display 105, detection grid 107, and game piece identity 112 of FIG. 1. It should further be noted that game piece 330 of FIG. 3 corresponds to game piece 230 of FIG. 2. Additionally, processor 102, memory 103, power supply 106, and communication interface 108 of conductive tray 101 have been removed from FIG. 3 for clarity purposes.

As illustrated in FIG. 3, conductive tray 301 includes input interface 304, display 305, and detection grid 307. Detection grid 307 includes a number of detection squares 335 spread out across an entire surface of detection grid 307, which are created in implementations that utilize alternating patterns of high-voltage and low-voltage lines, as will be illustrated in FIG. 4. Detection grid 307 thus detects an electrical change from game piece 330 when a resistor on game piece 330 closes a circuit using detection squares 335, such as when a resistor comes into contact with two of detection squares 335. For example, and as illustrated in FIG. 3, game piece 330 is located on detection grid 307 and in contact with two of detection squares 335, as shown by the dotted rectangle. One contact on a resistor of game piece 330 thus touches a first detection square while a second contact on the resistor touches a second detection square.

Also illustrated in FIG. 3 are ridges 340 on detection grid 307 of conductive tray 301. Ridges 340 are elevated portions of detection grid 307 that separate detection squares 335 so that a single contact of a resistor cannot contact two squares of detection squares 335 at the same time. As such, ridges 340 are merely constructed as tiny bumps on detection grid 307. Furthermore, in one implementation, ridges 340 may also include a separate current so that if a contact of a resistor lands on a ridge and a second contact of the resistor lands on a detection square, a circuit is still closed so that detection grid 307 can detect electrical changes. It is noted that only two ridges are illustrated on detection grid 307 in FIG. 3, however, that is merely for clarity purposes. In implementations that include ridges 340 on conductive grid 307, ridges 340 would be placed between each row and column of detection squares 335.

In the implementation of FIG. 3, a user of conductive tray 301 has rolled game piece 330 onto detection grid 307. Detection grid 307 detects an electrical change caused by a contact face of game piece 330, as the resistor on the contact face of game piece 330 is in contact with two of the squares of detection squares 335, as illustrated by the dashed rectangle. Conductive tray 301 would then use the electrical change caused by game piece 330 to calculate and identity game piece identity 312, which would correspond to the rolled face of game piece 330. Finally, conductive tray 301 would display game piece identity 312 on display 305. Game piece identity 312 of FIG. 3 would correspond to the number one, since, as illustrated in FIG. 3, game piece 330 has landed with a face of the number one showing.

Figure 4:
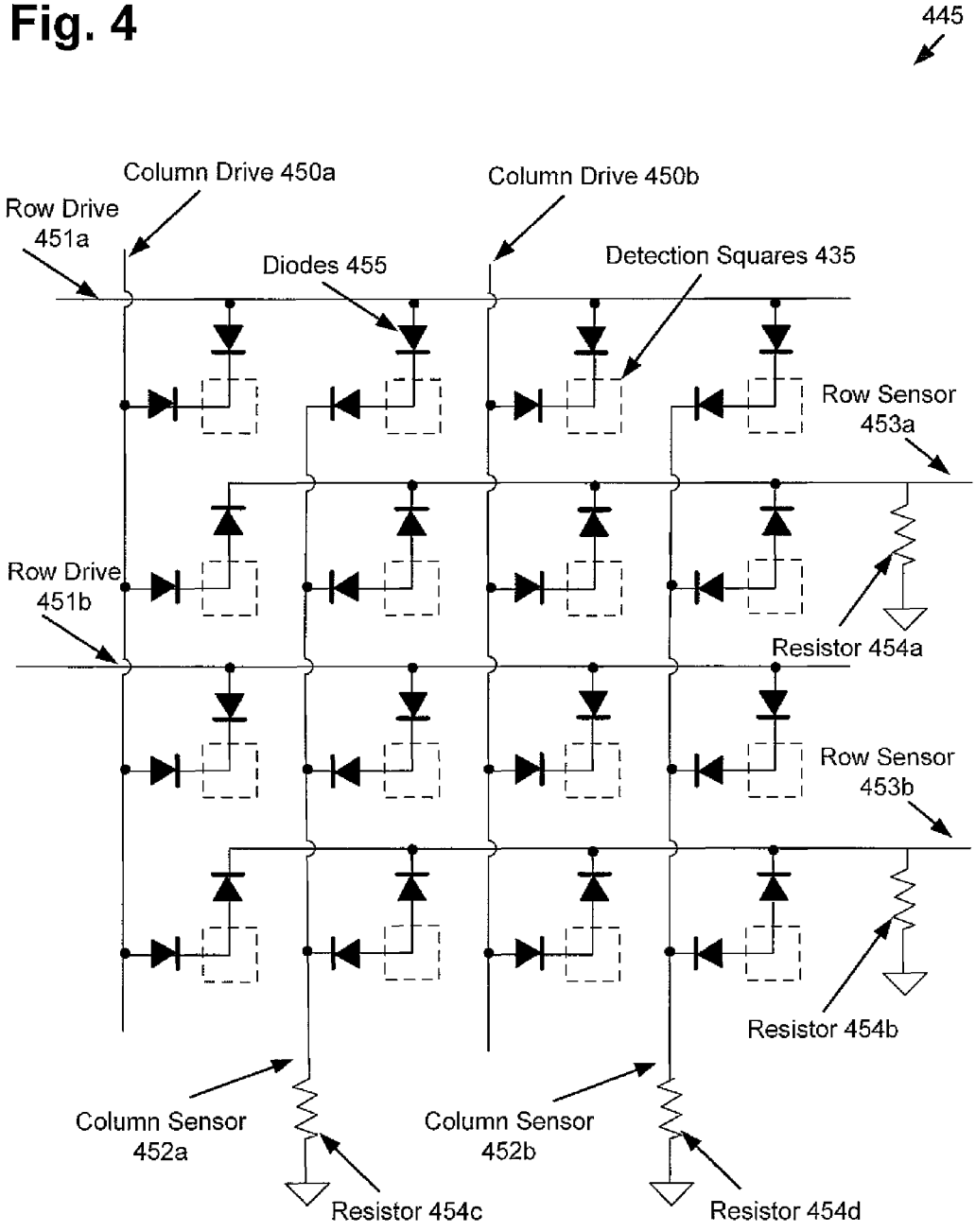
FIG. 4 presents an example of a voltage pattern for use in a detection grid of a conductive dice tray, according to one implementation of the present disclosure.

FIG. 4 presents an example of a voltage pattern for use in a detection grid of a conductive dice tray, according to one implementation of the present disclosure. Voltage pattern 445 of FIG. 4 includes detection squares 435, column drive 450*a*, column drive 450*b*, row drive 451*a*, row drive 451*b*, column sensor 452*a*, column sensor 452*b*, row sensor 453*a*, row sensor 453*b*, resistor 454*a*, resistor 454*b*, resistor 454*c*, resistor 454*d*, and diodes 455. With regards to FIG. 4, it should be noted that only one detection square of detection squares 435 and one diode of diodes 455 has been labeled for clarity purposes. Furthermore, detection squares 435 of FIG. 4 correspond to detection squares 335 of FIG. 3.

Voltage pattern 445 of FIG. 4 would be utilized in a conductive tray that uses resistance or capacitance to determine an identity of a game piece. For example, voltage pattern 445 may include an alternating pattern of high-voltage and low-voltage lines. In such an example, each of column drive 450*a*, column drive 450*b*, row drive 451*a*, and row drive 451*b* would power the different voltage lines according to voltage pattern 445, and each of column sensor, 452*a*, column sensor 452*b*, row sensor 453*a*, and row sensor 453*b* would detect for changes in the resistance or capacitance across high/low divides. In reference to FIG. 1, the sensors would thus correspond to detection circuitry 111 detecting electrical change 113 in the voltage pattern.

As illustrated in FIG. 4, by setting up voltage pattern 445 with an alternating pattern of voltage lines along with a series of diodes 455, detection squares 435 are created in voltage pattern 445. A game piece that lands on a detective grid that utilizes voltage pattern 445 would thus be detected when one contact of a resistor on the game piece comes into contact with one of detection squares 435, and a second contact of the resistor comes into contact with a second of detection squares 435. The game piece would thus close a circuit in voltage pattern 445, and one of the sensors of voltage pattern 445 could then determine the resistance of the resistor, which, as discussed above, corresponds to electrical change 113 of FIG. 1.

It should be noted that voltage pattern 445 may further include an alternating voltage pattern that flips the voltage lines so that a game piece can be detected in any orientation. The alternating voltage pattern, along with a frequency for the alternating voltage pattern, could be set by a user of the conductive tray. For example, and using FIG. 1 above, a user of conductive tray 101 may utilize input interface 104 to input user input 115 in order to change circuitry control 110. As discussed above, circuitry control 110 may control the type of alternating voltage pattern, the frequency of alternating voltage pattern, and how long to power detection grid 107 at each change in voltage pattern.

Figure 5:
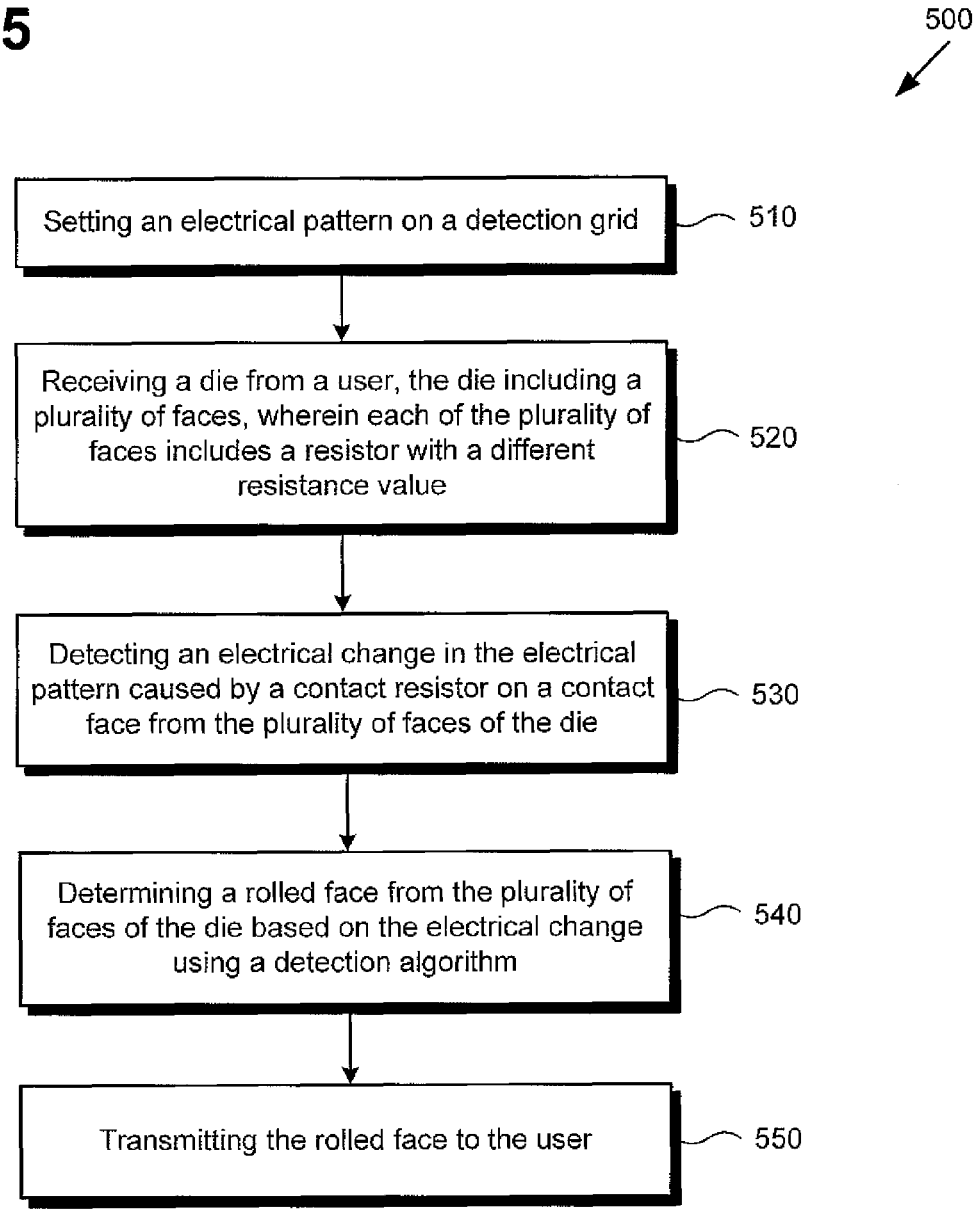
FIG. 5 shows a flowchart illustrating a method for digitally detecting a physical dice roll using a conductive dice tray, according to one implementation of the present disclosure.

FIG. 5 shows a flowchart illustrating a method for digitally detecting a physical dice roll using a conductive detection tray, according to one implementation of the present disclosure. The approach and technique indicated by flowchart 500 are sufficient to describe at least one implementation of the present disclosure, however, other implementations of the disclosure may utilize approaches and techniques different from those shown in flowchart 500. Furthermore, while flowchart 500 is described with respect to FIGS. 1, 2, and 3, the disclosed inventive concepts are not intended to be limited by specific features shown and described with respect to FIGS. 1, 2, and 3. Furthermore, with respect to the method illustrated in FIG. 5, it is noted that certain details and features have been left out of flowchart 500 in order not to obscure the discussion of inventive features in the present application.

Referring now to flowchart 500 of FIG. 5, flowchart 500 includes setting an electrical pattern on a detection grid (510). For example, processor 102 of conductive tray 101/301 may receive user input 115 through input interface 104/304 for controlling circuitry control 110. As discussed above, circuitry control 110 can be used to control detection grid 107/307. Processor 102 can thus receive user input 115 and set electrical patterns for detection grid 107/307. As illustrated in FIG. 4, a detection pattern can include an alternating voltage pattern of high-voltage and low-voltage lines. Furthermore, the alternating voltage pattern can be flipped back and forth with a set frequency between the different voltage lines so that detection circuitry 111 can detect a game piece in any orientation on detection grid 107/307.

Flowchart 500 also includes receiving a die from a user, the die including a plurality of faces, wherein each of the plurality of faces includes a resistor with a different resistance value (520). For example, processor 102 of conductive tray 101/301 may detect when game piece 230/330 is rolled on detection grid 107/307. As illustrated in FIG. 2, game piece 230/330 may include a die with a plurality of faces. Each face of game piece 230/330 may include a resistor with a different resistance value, such as resistors 231-234. Conductive tray 101/301 can thus detect game piece 230/330 by electrical change 113 caused by one of resistors 231-234 coming into contact with conductive grid 107/307.

Flowchart 500 also includes detecting an electrical change in the electrical pattern caused by a contact resistor on a contact face from the plurality of faces of the die (530). For example, processor 102 of conductive tray 101/301 may detect electrical change 113 caused by one of resistors 231-234 on a contact face of game piece 230/330. The contact face of game piece 230/330 is the face that is in contact with detective grid 107/307 of conductive tray 101/301. As illustrated in FIG. 3, the contact face of game piece 230/330 would be the face opposite the first face, as the first face is facing upwards. As such, detection circuitry 111 of detection grid 107/307 will detect electrical change 113 caused by whichever resistor from resistors 231-234 is disposed on the contact face.

Flowchart 500 also includes determining a rolled face from the plurality of faces of the die based on the electrical change using a detection algorithm (540). For example, processor 102 of conductive tray 101/301 determines game piece identity 112/312 based on electrical change 113 using detection algorithm 109 in memory 103. In such example, game piece identity 112/312 corresponds to the rolled face of game piece 230/330, or sticking with the example above and as illustrated in FIG. 3, the first face of game piece 230/330.

Flowchart 500 also includes transmitting the rolled face to the user (550). For example, processor 102 of conductive tray 101/301 may transmit game piece identity 112/312 to a user, where game piece identity 112/312 corresponds to the rolled face of the die. As discussed above, processor 102 can transmit game piece identity 112/312 to the user using two different methods. In a first method, processor 102 can display game piece identity 112/312 to the user using display 105/305, as illustrated in FIG. 3. In a second method, processor 102 can transmit game piece identity 112/312 to user device 120 using communication link 116, where communication interface 108 includes Bluetooth. Processor 121 of user device 120 can then receive game piece identity 112/312 from conductive tray 101/301 using communication interface 123, and display game piece identity 112/312 on display 122 of user device 120.

It should be noted that the method and examples described in FIG. 5 only discuss game piece 230/330 as including a die, however, as discussed above, the present disclosure is not limited to game piece 230/330 only including a die. In other implementations, game piece 230/330 may include any type of game piece that a user can utilize to play physical games. For example, game pieces can include, but is not limited to, an action figure, cards, blocks, marbles, or chips. Furthermore, game pieces can include any number of resistors on any number of sides. For example, if a playing card is used as a game piece, a resistor may be placed on a front face of the playing card while a second resistor with a different resistance value may be placed on a back face of the playing card. As such, conductive tray 101/301 would be able to determine if the front face or the back face of the playing card is showing depending on an electrical change caused by one of the resistors on the playing card.

It should further be noted that the method and examples described in FIG. 5 only discuss a single game piece 230/330, however, as discussed above, the present disclosure is not limited to using a single game pieces. In other implementations, multiple game pieces may be used and identified on conductive tray 101/301. For example, conductive tray 101/301 may be utilized to determine the rolled face of multiple dice rolled at the same time.

From the above description it is manifest that various techniques can be used for implementing the concepts described in the present application without departing from the scope of those concepts. Moreover, while the concepts have been described with specific reference to certain implementations, a person of ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

What is claimed is:

1. A conductive tray for determining a rolled face from a plurality of faces of a die, each of the plurality of faces of the die includes a resistor with a different resistance value, the conductive tray comprising:

a detection grid having voltage lines;

a memory storing a detection algorithm; and a processor configured to:

detect a voltage change on the detection grid caused by the die contacting the detection grid;

determine the rolled face of the die based on the voltage change using the detection algorithm, wherein the voltage change is different based on the resistance value of the face of the die contacting the detection grid; and transmit the rolled face of the die.

2. The conductive tray of claim 1, wherein the voltage lines of the detection grid includes an alternating pattern of first voltage lines and second voltage lines, wherein the first voltage lines conduct a higher voltage than the second voltage lines.

3. The conductive tray of claim 1, wherein transmitting the rolled face includes transmitting the rolled face to a user device wirelessly.

4. The conductive tray of claim 1, wherein the voltage lines of the detection grid include a plurality of detection squares, wherein the die is detected when the resistor of the face of the die contacting the detection grid contacts two of the plurality of detection squares.

5. The conductive tray of claim 1, further comprising another die, wherein the processor is further configured to:

detect a total voltage change on the detection grid caused by the die and the another die;

determine the rolled face of the die and another rolled face of the another die based on the total voltage change using the detection algorithm, wherein the total voltage change is different based on the resistance value of the face of the die contacting the detection grid and the resistance value of the face of the another die contacting the detection grid; and transmit the rolled face and the another rolled face.

6. A method for determining a rolled face from a plurality of faces of a die, each of the plurality of faces of the die includes a resistor with a different resistance value, the method comprising:

detecting a voltage change on a detection grid having voltage lines, the voltage change being caused by the die contacting the detection grid;

determining the rolled face of the die based on the voltage change using the detection algorithm, wherein the voltage change is different based on the resistance value of the face of the die contacting the detection grid; and transmitting the rolled face of the die.

7. The method of claim 6, wherein the voltage lines of the detection grid includes an alternating pattern of first voltage lines and second voltage lines, wherein the first voltage lines conduct a higher voltage than the second voltage lines.

8. The method of claim 6, wherein transmitting the rolled face includes transmitting the rolled face to a user device wirelessly.

9. The method of claim 6, wherein the voltage lines of the detection grid include a plurality of detection squares, when the resistor of the face of the (lie contacting the detection grid contacts two of the plurality of detection squares.

10. The method of claim 6, further comprising detecting a total voltage change on the detection grid caused by the die and another die, determine the rolled face of the die and another rolled face of the another die based on the total voltage change using the detection algorithm, wherein the total voltage change is different based on the resistance value of the face of the die contacting the detection grid and the resistance value of the face of the another die contacting the detection grid.

11. A conductive tray for identifying a plurality of game pieces including a first game piece, each of the plurality of game pieces having a resistor with a different resistance value. the conductive tray comprising:

a detection grid having voltage lines;

a memory storing a detection algorithm; and a processor configured to:

detect a voltage change on the detection grid caused by the first game piece contacting the detection grid;

determine the identity of the first game pieces based on the voltage change using the detection algorithm, wherein the voltage change is different based on the resistance value of the first game piece contacting the detection grid; and transmit the identity of the game piece.

12. The conductive tray of claim 11, wherein the voltage lines of the detection grid includes an alternating pattern of first voltage lines and second voltage lines, wherein the first voltage lines conduct a higher voltage than the second voltage lines.

13. The conductive tray of claim 11, wherein the processor is further configured to:

detect a total voltage change on the detection grid caused by the first game piece and a second game piece of the plurality of game pieces;

determine the identity of the first game piece and another identity of the second game piece based on the total voltage change using the detection algorithm, wherein the total voltage change is different based on the resistance value of the first game piece contacting the detection grid and the resistance value of the second game piece the detection grid; and transmit the identity and the another identity.

14. The conductive tray of claim 11, wherein transmitting the identity includes transmitting the identity to a user device wirelessly.

15. The conductive tray of claim 11, the voltage lines of the detection grid include a plurality of detection squares separated by a plurality of ridges, wherein the first game piece is detected when the resistor on the first game piece contacts two of the plurality of detection squares.

16. A game piece for use with a conductive tray including a detection grid having voltage lines, the game piece comprising:

a plurality of faces, each of the plurality of faces of the game piece including a resistor with a different resistance value;

wherein when the game piece contacts the detection grid using a face of the plurality of face, the face of the game piece causes a voltage change on the detection grid, and wherein the voltage change is different based on the resistance value of each of the plurality of faces of the game piece contacting the detection grid, so as to identify the face of the game piece contacting the detection grid.

17. The game piece of claim 16, wherein the game piece is a die.

* * * * *